US012031727B2

(12) United States Patent
Garcia et al.

(10) Patent No.: US 12,031,727 B2
(45) Date of Patent: Jul. 9, 2024

(54) OVEN BAKE HEATING CHANNEL EXCHANGE SYSTEM

(71) Applicant: Electrolux Home Products, Inc., Charlotte, NC (US)

(72) Inventors: Andre Garcia, Hendersonville, TN (US); Michael D. Padgett, Springfield, TN (US); Zhi Tan, Hangzhou (CN); Huss Pan, Bengbu (CN)

(73) Assignee: Electrolux Home Products, Inc., Charlotte, NC (US)

( * ) Notice: Subject to any disclaimer, the term of this patent is extended or adjusted under 35 U.S.C. 154(b) by 488 days.

(21) Appl. No.: 17/193,330

(22) Filed: Mar. 5, 2021

(65) Prior Publication Data

US 2022/0282871 A1 Sep. 8, 2022

(51) Int. Cl.
*F24C 3/08* (2006.01)
*F24C 15/32* (2006.01)

(52) U.S. Cl.
CPC ..... *F24C 3/087* (2013.01); *F24C 15/322* (2013.01)

(58) Field of Classification Search
CPC ..... F24C 3/087; F24C 15/32; F24C 15/322; A21B 1/28; F24H 3/025
See application file for complete search history.

(56) References Cited

U.S. PATENT DOCUMENTS 623,348 A * 4/1899 Allington ..... F28D 1/024 165/125
2,410,285 A * 10/1946 Herbster ..... F24C 15/322 126/39 C
3,590,803 A 7/1971 Sauer
3,719,180 A * 3/1973 Pere ..... A21B 1/26 126/21 A
4,108,139 A 8/1978 Gilliom et al.
4,109,636 A 8/1978 Burge
(Continued)

FOREIGN PATENT DOCUMENTS

CN 204187954 3/2015
DE 2351072 4/1975
(Continued)

OTHER PUBLICATIONS

International Search Report and Written Opinion for PCT/US2022/016527, dated Aug. 24, 2022, 39 pages.
(Continued)

*Primary Examiner* — Jorge A Pereiro
(74) *Attorney, Agent, or Firm* — Pearne & Gordon LLP

(57) ABSTRACT

A cooking appliance includes: a cooking cavity with a bottom wall and a rear wall. A convection fan is disposed adjacent to the rear wall of the cooking cavity. A gas burner is located in a subjacent space beneath the bottom wall and adjacent to the rear wall of the cooking cavity. A heat duct provides communication through the bottom wall and includes an inlet positioned directly above and adjacent to the gas burner through which combustion gases from the gas burner can enter the heat duct. An annular portion of the heat duct defines a pass-through opening in which the convection fan is disposed. Flames from the gas burner extend upwardly toward or through the inlet of the heat duct and are substantially isolated from turbulent air flow generated by the convection fan.

19 Claims, 9 Drawing Sheets

(56) References Cited

U.S. PATENT DOCUMENTS

| | | | | |
|---|---|---|---|---|
| 4,339,647 | A | 7/1982 | Inayama et al. | |
| 4,498,453 | A | 2/1985 | Ueda | |
| 4,516,012 | A | 5/1985 | Smith et al. | |
| 4,624,301 | A | 11/1986 | Baggott et al. | |
| 4,648,377 | A * | 3/1987 | Van Camp | F24C 15/322 126/91 A |
| 4,813,398 | A * | 3/1989 | Savage | F24C 15/322 165/125 |
| 4,867,132 | A | 9/1989 | Yencha | |
| 4,926,837 | A * | 5/1990 | Parker | F24C 3/128 219/400 |
| 5,222,474 | A | 6/1993 | Yencha, III | |
| 5,497,760 | A * | 3/1996 | Alden | F24C 15/322 126/21 R |
| 5,601,070 | A * | 2/1997 | Hotard | F24C 15/322 219/400 |
| 5,655,511 | A * | 8/1997 | Prabhu | F24C 15/322 126/21 R |
| 6,371,104 | B1 * | 4/2002 | Voohris | F24C 15/322 126/273 R |
| 6,776,151 | B2 | 8/2004 | Wiersma et al. | |
| 7,422,009 | B2 | 9/2008 | Rummel et al. | |
| 7,759,617 | B2 | 7/2010 | Bowles et al. | |
| 8,106,334 | B2 * | 1/2012 | Nam | F24C 15/322 219/400 |
| 8,973,568 | B2 | 3/2015 | Schonemann et al. | |
| 9,188,344 | B2 * | 11/2015 | Murray | F24C 15/322 |
| 9,388,992 | B2 | 7/2016 | Wie et al. | |
| 9,488,377 | B2 | 11/2016 | Wie et al. | |
| 9,534,791 | B2 | 1/2017 | Wie et al. | |
| 9,874,357 | B2 | 1/2018 | Wie et al. | |
| 9,939,159 | B2 | 4/2018 | Wie et al. | |
| 9,939,161 | B2 | 4/2018 | Jeong et al. | |
| 10,145,567 | B2 | 12/2018 | Yang et al. | |
| 10,295,196 | B2 | 5/2019 | Seok et al. | |
| 10,330,323 | B2 * | 6/2019 | Kim | F24C 3/122 |
| 10,422,537 | B2 | 9/2019 | Lee et al. | |
| 10,429,081 | B2 | 10/2019 | Park et al. | |
| 10,539,331 | B2 | 1/2020 | Seok et al. | |
| 11,391,468 | B2 * | 7/2022 | Yang | F24C 15/322 |
| 2003/0140917 | A1 * | 7/2003 | Rummel | F24C 15/322 126/21 R |
| 2005/0103322 | A1 | 5/2005 | Smith et al. | |
| 2015/0107576 | A1 * | 4/2015 | Jeong | F24C 15/322 126/39 C |
| 2015/0122242 | A1 * | 5/2015 | Murray | F24C 15/001 126/289 |
| 2015/0330642 | A1 | 11/2015 | Vasan | |
| 2016/0209027 | A1 * | 7/2016 | Yoon | F24C 3/103 |
| 2016/0238259 | A1 * | 8/2016 | Park | F24C 15/322 |
| 2017/0130964 | A1 | 5/2017 | Vasan | |
| 2019/0003718 | A1 | 1/2019 | Lee et al. | |
| 2019/0003724 | A1 | 1/2019 | Jeong et al. | |
| 2019/0063757 | A1 * | 2/2019 | Yang | F24C 15/322 |
| 2019/0154254 | A1 * | 5/2019 | Yoon | F23D 14/10 |
| 2020/0309380 | A1 * | 10/2020 | Martin | F24H 3/06 |
| 2021/0190312 | A1 * | 6/2021 | Yoon | F23D 14/10 |

FOREIGN PATENT DOCUMENTS

| | | | |
|---|---|---|---|
| DE | 2657267 | | 6/1978 |
| DE | 8110034 | | 9/1981 |
| DE | 3931621 | | 4/1991 |
| DE | 19627300 | | 1/1998 |
| DE | 10140007 | | 3/2003 |
| EP | 0062231 | | 10/1982 |
| EP | 0115838 | | 8/1984 |
| EP | 0189856 | A2 * | 8/1986 |
| EP | 0388605 | | 9/1990 |
| EP | 0526768 | | 2/1993 |
| EP | 1424008 | | 6/2004 |
| EP | 3412975 | | 12/2018 |
| EP | 3421887 | | 1/2019 |
| FR | 2514612 | | 4/1983 |
| GB | 1459311 | | 12/1976 |
| GB | 1503314 | | 3/1978 |
| GB | 2028069 | | 2/1980 |
| GB | 2388424 | | 11/2003 |
| JP | S5388363 | | 8/1978 |
| JP | S54115973 | | 9/1979 |
| JP | S54115974 | | 9/1979 |
| JP | S5685641 | | 7/1981 |
| JP | S58219334 | | 12/1983 |
| JP | 01159536 | A * | 6/1989 |
| JP | 10038280 | A * | 2/1998 |
| JP | H1038280 | | 2/1998 |
| KR | 930020114 | | 9/1993 |
| KR | 101428872 | | 6/2014 |
| KR | 101623634 | | 10/2015 |
| KR | 20150115193 | A * | 10/2015 |
| NL | 7614079 | | 6/1978 |

OTHER PUBLICATIONS

Invitation to Pay Fees and Provisional Opinion of the ISA for PCT/US2022/016527, dated May 20, 2022, 27 pages.

Oven, Stove, Range, and Cooktop Repair. Page 3; Paragraph 6. https://www.appliancerepair.net/oven-repair-3.html.

* cited by examiner

OVEN BAKE HEATING CHANNEL EXCHANGE SYSTEM

BACKGROUND

1. Field of the Invention

The following description relates generally to a gas oven and, more specifically, to a gas burner with a heating channel exchange system for an oven.

2. Description of Related Art

A convection oven includes a fan, typically positioned at a rear wall of a cooking cavity, and at least one heating element, such as a gas burner or electric heating element. The fan blows hot air from the heating element(s) over and around food in the cooking cavity in order to cook the food more quickly and evenly than in non-convection ovens. This air is then vented out through an exhaust system. The use of a gas burner in a convection oven has been problematic as the presence of turbulent airflow from the fan affects the flame from the burner. More specifically, the fan flow turbulence tends to separate the flame from its anchoring burner and to extinguish the flame, thereby affecting the efficiency of the burner. Also, the flame must be lit or initiated when the burner is turned on. Turbulent air flow in the fan chamber affects the ignition operation and hampers flame ignition, blowing the gas away from the ignitor.

SUMMARY

The following presents a simplified summary in order to provide a basic understanding of embodiments described herein. This summary is not an extensive overview nor is it intended to identify key or critical elements. Its sole purpose is to present some concepts in a simplified form as a prelude to the more detailed description that is presented later.

According to one embodiment, a cooking appliance is provided. The cooking appliance includes a cooking cavity and a convection fan disposed adjacent to a rear wall of the cooking cavity. A gas burner is located in a space beneath the bottom wall at a rear portion of the cooking cavity. A heat duct is positioned within the cooking cavity and includes an inlet positioned directly above the gas burner, through which combustion gases from the gas burner can enter the duct, and an annular portion defining a fan opening in which the convection fan is disposed. The annular portion includes one or more outlets through which combustion gases can exit the heat duct. Flames from the gas burner extend upwardly toward or through said inlet of said heat duct and are substantially isolated from turbulent air flow generated by the convection fan.

According to another embodiment, a cooking appliance is provided which includes a cooking cavity having a convection fan disposed adjacent a rear wall of the cooking cavity. A bottom panel is positioned at a bottom portion of the cooking cavity and includes an opening at a rear portion of the bottom panel. A gas burner is positioned directly below the opening in the bottom panel, A heat duct is provided which includes an inlet positioned directly above the opening in the bottom panel, an outlet positioned through a front face of the heat duct, and a channel extending between the inlet and the outlet. Combustion gases from the gas burner can travel through the heat duct channel and are substantially isolated from turbulent air flow generated by the convection fan.

According to another embodiment, a cooking appliance is provided. The cooking appliance includes a cooking cavity having a rear wall and a bottom wall; a gas burner positioned below the bottom wall; a heat duct positioned at a rear portion of the cooking cavity, the heat duct having an inlet positioned directly above the gas burner, an outlet, a channel formed between the inlet and the outlet, and a pass-through opening; and a convection fan positioned adjacent the rear wall and extending into the pass-through opening of the heat duct.

Other features and aspects will be apparent from the following detailed description, the drawings, and the claims.

BRIEF DESCRIPTION OF THE DRAWINGS

Throughout the drawings and the detailed description, unless otherwise described, the same drawing reference numerals can be understood to refer to the same elements, features, and structures. The relative size and depiction of these elements may be exaggerated for clarity, illustration, and convenience.

DETAILED DESCRIPTION

Figure 1:
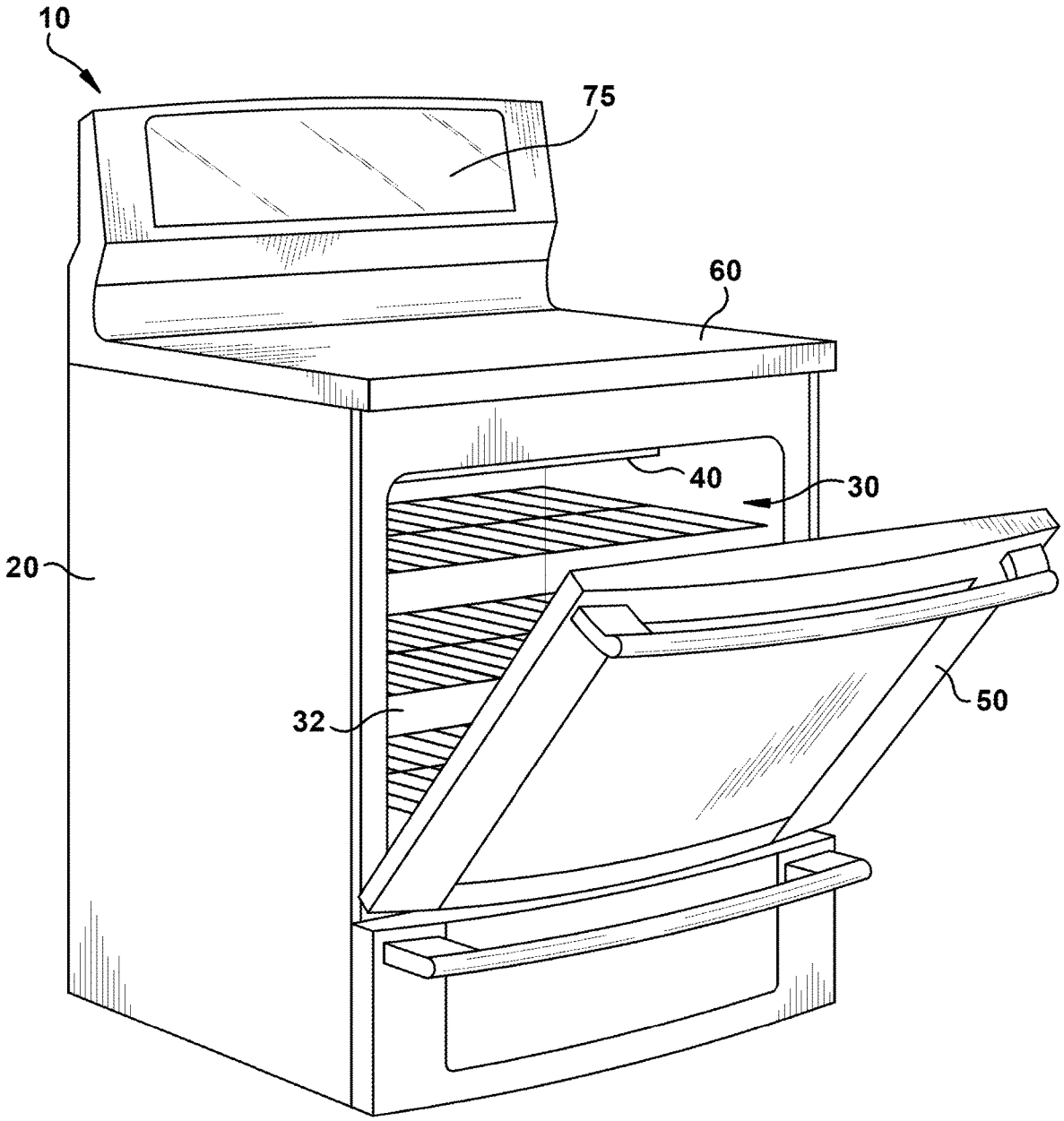
FIG. 1 illustrates a perspective view of an oven in accordance with an embodiment.

Example embodiments are described and illustrated herein. These illustrated examples are not intended to be a limitation on the present embodiments. For example, one or more aspects of the system can be utilized in other embodiments and other types of appliances. More specifically, example embodiments of a heating channel exchange system for a gas cooking appliance will be described more fully hereinafter with reference to the accompanying drawings. Such systems may, however, be embodied in many different forms and should not be construed as limited to the embodiments set forth herein. Like, but not necessarily the same, elements (also sometimes called modules) in the various figures are denoted by like reference numerals for consistency. Terms such as "first," "second," "front," and "rear" are used merely to distinguish one component (or part of a component or state of a component) from another. Such terms are not intended to denote a preference or a particular orientation.

FIG. 1 shows an illustrative embodiment of a cooking appliance, or oven, 10. The illustrated oven 10 is a freestanding oven with a cooktop; however, the system described herein can be incorporated into other oven structures, such as built-in, wall-mounted, double ovens, etc. In the case of a freestanding configuration, as illustrated in FIG. 1, the oven 10 can include an outer cabinet 20 and a cooking cavity 30 positioned within the outer cabinet 20. The oven 10 includes a front opening 40 for access to the cooking cavity 30 and a door 60 for closing the cooking cavity 30. The oven 10 uses gas as a heat source and includes a gas burner positioned in a bottom portion of the oven 10, as will be described in greater detail below, and a heating element 50 (which can be gas or electric) positioned at an upper portion of the cooking cavity 30. A top portion of the cabinet 20 can include a cooktop 70 and a control panel 75, which controls heat sources of the oven 10. It is to be appreciated that alternate embodiments of the cooking appliance can include only a cooking cavity without the cooktop 70 and can be used in a variety of different configurations such as built-in ovens, etc. In addition, the oven 10 may include more than one cooking cavity 30, with or without a cooktop 70. For example, the oven 10 may include two oven cavities (a "double-cavity" configuration). However, configurations are not limited thereto and more than two oven cavities may be included in other embodiments. For the sake of brevity, however, the embodiment of the cooking appliance shown in FIG. 1 will be used as an example to describe the oven below.

As shown in FIG. 1, the oven door 60 closes the front opening 40 of the outer cabinet 20 and encloses the cooking cavity 30 from the environment external to the oven 10. The oven door 60 is pivotally mounted to the cabinet 20, e.g., to a lower frame 80 of the cabinet 20. The door 60 can be pivoted around a horizontal pivot point (not shown on FIG. 1) between a horizontal position in which the front opening 40 is open for access by the user of the appliance, and a vertical position in which the front opening 40 is closed by the door 60. Alternatively, the oven door 60 may be mounted to a left side frame or a right side frame of a front panel 90 of the cabinet 20. In such configuration, the oven door 60 can be tilted around a vertical pivot point adjacent to a side section of the cooking cavity 30. The door 60 can include a transparent section, such as a glass window, so that the user can see into the cooking cavity 30 during operation of the oven without opening the door 60.

Figure 2:
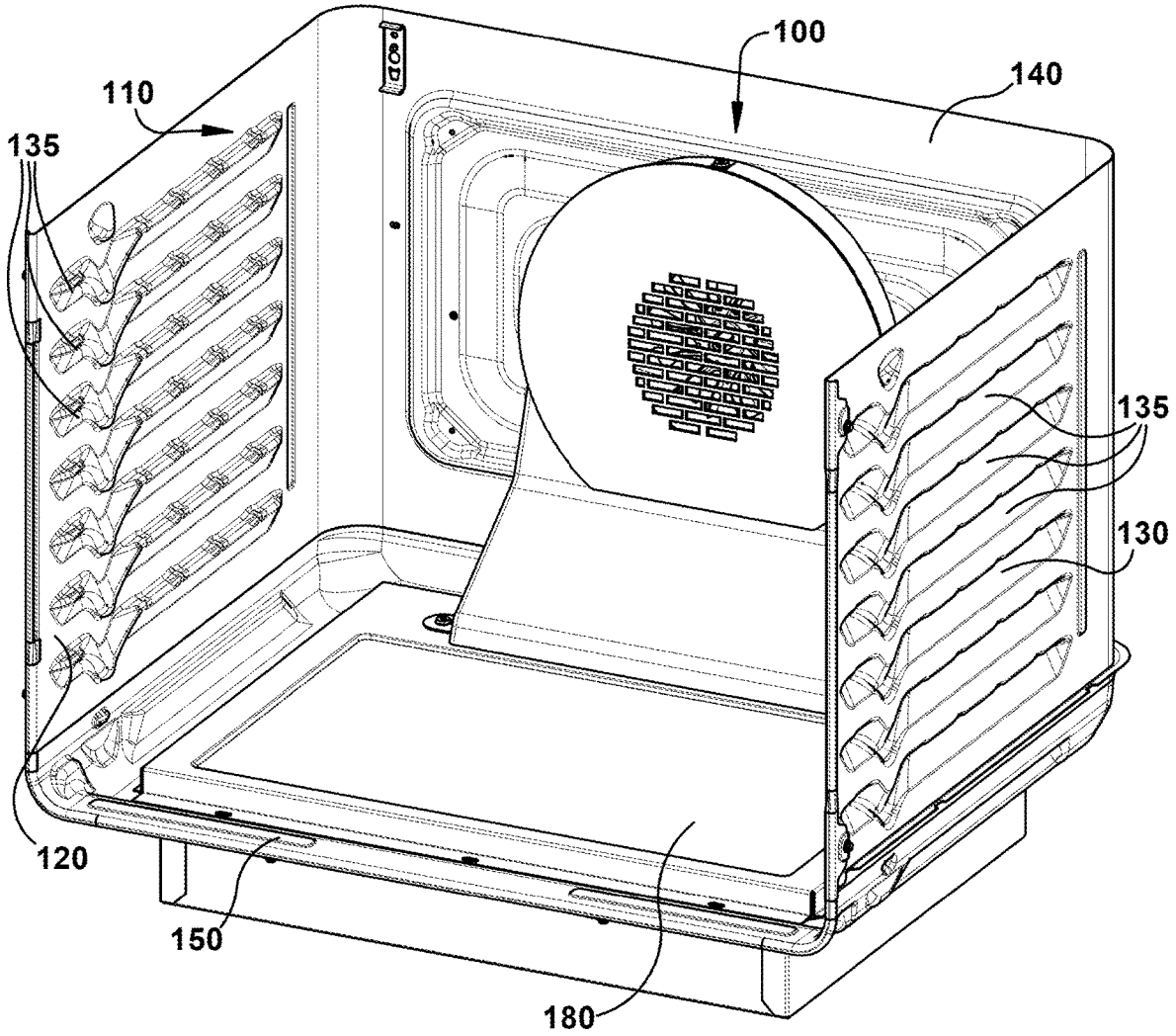
FIG. 2 illustrates a perspective view of a cooking cavity having a heating channel exchange system in accordance with an embodiment.
Figure 3:
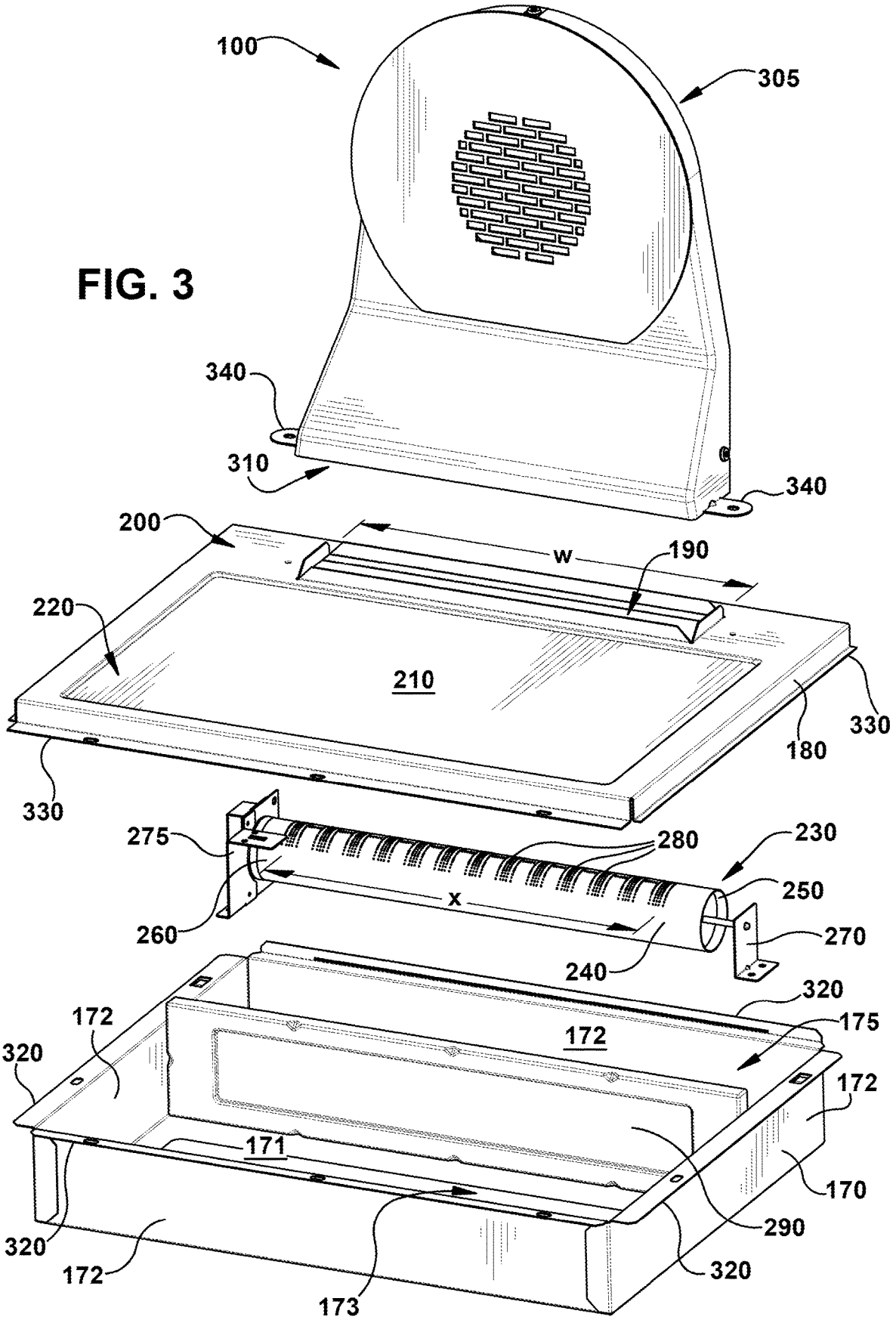
FIG. 3 illustrates an exploded perspective view of a heating channel exchange system in accordance with an embodiment.
Figure 4:
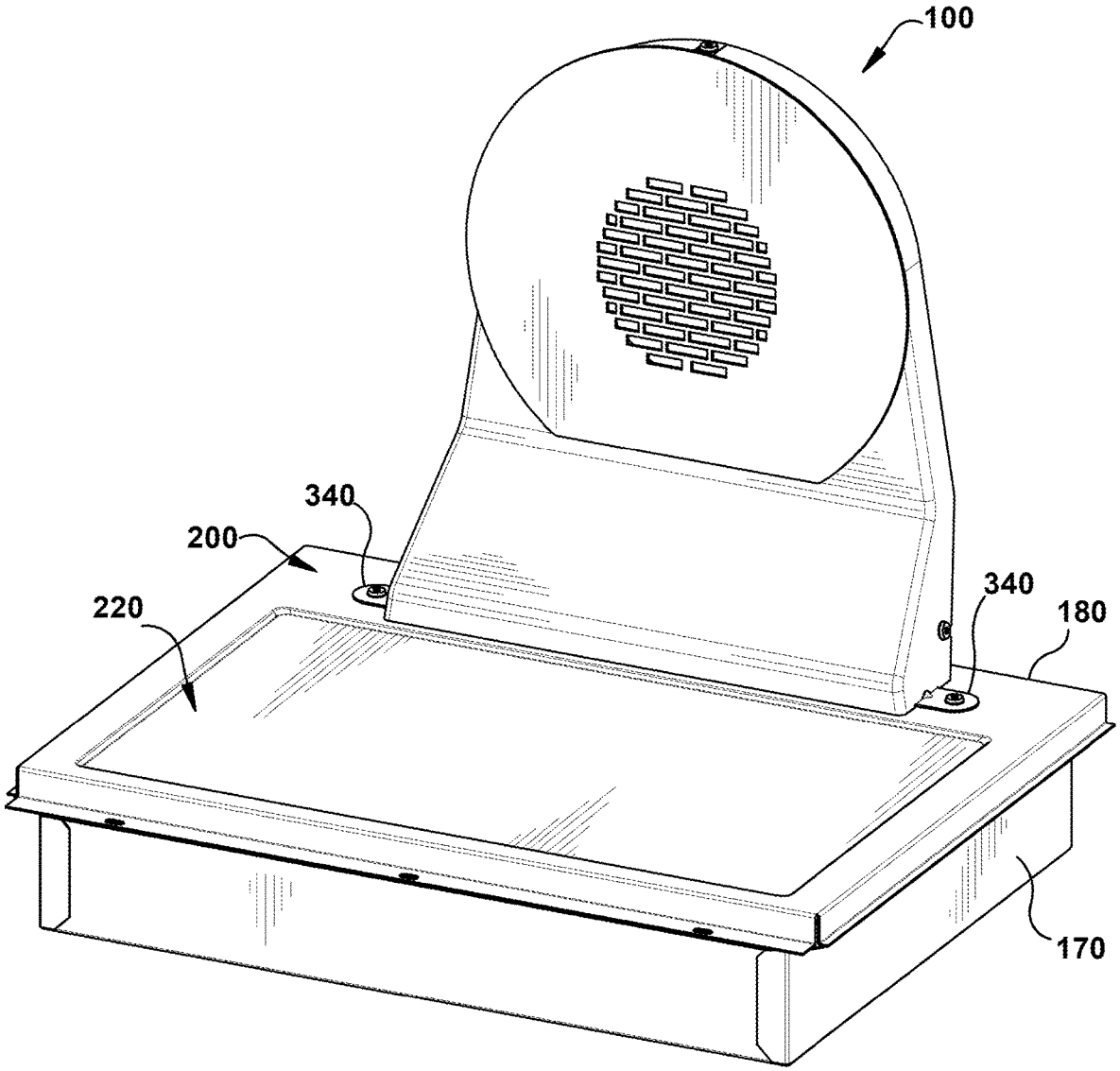
FIG. 4 illustrates a perspective view of a heating channel exchange system in accordance with an embodiment.

Turning now to FIGS. 2 through 4, a heating channel exchange system 100 for an oven is illustrated in accordance with an example embodiment. FIG. 2 illustrates the heating channel exchange system 100 positioned within a cooking cavity 110 of the oven. The cooking cavity 110 is defined by a first sidewall 120, a second sidewall 130, a rear wall 140, a bottom wall 150, and a top wall (not shown). The first and second sidewalls 120, 130 include a plurality of rack supports 135 either integrally formed with the first and second sidewalls 120, 130, as shown, and/or secured to the first and second sidewalls 120, 130, as known in the art. A convection fan assembly 160 is secured to or at the rear wall 140 (FIGS. 7 and 8) to facilitate the circulation of air within the cooking cavity 110 during a cooking operation. Although not depicted, the top wall of the cooking cavity 110 can support an upper heating element, such as a gas broil element. The bottom wall 150 includes a central opening (not shown) that corresponds with a burner box 170 and a bottom panel 180 assembly, as described in greater detail below. The burner box 170 and the bottom panel 180 can be made of an enameled sheet metal, or any other suitable material sufficient to withstand cooking and self-cleaning oven temperatures.

As shown in FIG. 3, the bottom panel 180 includes at least one opening 190 at a rear portion 200 thereof. A top surface 210 of the bottom panel 180 may include a recessed portion 220 to catch and contain any spilled food or liquids in the oven. The burner box 170 is positioned below the bottom panel 180 and is formed as an open top box having a bottom wall 171 and four sidewalls 172 extending upwards from the bottom wall 171. Extending between two opposing sidewalls 172 is a wall or partition 290 that divides the burner box 170 into at least two subjacent spaces beneath the bottom wall 150 of the cooking cavity 110. In the present example, the partition 290 separates the burner box 170 into a front section 173 and a rear section 175. Thus, a width of the partition 290 extends from a first sidewall to an opposing second sidewall of the burner box 170. A height of the partition 290 extends from a bottom of the burner box 170 to a bottom surface of the bottom panel 180 when the burner box 170 and bottom panel 180 are assembled. Thus, the partition 290 is positioned and sized to substantially block fluid communication between the front section 173 and the rear section 175 when assembled.

Located within the rear section 175 of the burner box 170 is a gas burner 230. Thus, the gas burner 230 is located within a subjacent space beneath the bottom wall 150 of the cooking cavity 110. The gas burner 230 includes a body 240 having a generally tubular configuration, which forms a fuel receiving chamber therein. The burner 230 extends along a longitudinal axis substantially parallel with the rear wall of the oven cavity 140 and includes a first end 250 and a second end 260. The first end 250 can be coupled to a bracket 270 for securing the burner 230 in place within the burner box 170. The second end 260 can be coupled to a valve for controlling a flow of gas through the burner 230. The second end 260 may also be secured to the burner box 170 via a second bracket 275. A plurality of ports 280 are formed through a top portion of the burner body 240 and distributed in its upper surface over substantially its entire length. The ports 280 can be of any suitable number, shape, and size as desired. When fuel is provided through the burner body 240, the fuel flows out through the ports 280 and can be ignited by an ignition system in a conventional manner. One or more small holes (not shown) are provided through a sidewall and/or bottom wall of the rear section 175 of the burner box 170 in order to feed air to the gas burner 230 for combustion.

When assembled, the rear opening 190 of the bottom panel 180 is positioned directly above the rear section 175 of the burner box 170. More specifically, the rear opening 190 is positioned directly over the gas burner 230 such that flames and/or heat exiting from the gas burner ports 280 extend upwardly towards and pass directly through the rear opening 190. Accordingly, the rear opening 190 can be of a size and shape that corresponds with the ports 280 (or with the array of ports 280) in the burner body 240. In other words, as shown in FIG. 3, the rear opening 190 can be substantially rectangular with a width W and a depth D. The width W of the rear opening 190 can be equal to or greater than a distance X, measured as the distance between a burner port closest to the first end 250 of the burner body 240 and burner port closest to the second end 260 of the burner body 240. Thus, each of the plurality of burner ports 280 are visible when looking through the rear opening 190 from a top portion of the bottom panel 180 towards the gas burner 230.

A heat duct 305 is provided at a rear portion of the oven inside the cooking cavity 110, directly in front of the rear wall 140. The heat duct 305 is configured to direct heated air flow from the gas burner 230 towards the convection fan assembly 160. The heat duct 305 is open at a bottom thereof to define an inlet port 310. The inlet port 310 is positioned directly above the rear opening 190 of the bottom panel 180. Thus, the heated air generated by the gas burner 230 flows upward through the opening 190 and into the inlet port 310. The inlet port 310 of the heat duct 305 is of a width and depth that corresponds with, or is slightly larger than, a width and depth of the rear opening 190 such that the inlet port 310 substantially covers the rear opening 190 of the bottom plate 180 when the heat duct 305 is coupled to the bottom plate 180. Likewise, the width of the inlet port 310 corresponds with a linear extent of the gas burner 230, or in other words, is sized such that flames exiting from the burner ports 280 can extend upward into or toward the inlet port 310 of the heat duct 305. After entering the inlet port 310 of the heat duct 305, the heated air flows upward through the heat duct 305 towards the convection fan assembly 160. The convection fan then circulates the burner exhaust air mixed with the air from the cooking cavity around the cavity, as will be described in more detail below.

The brackets 270, 275 of the burner assembly can be coupled directly to a bottom of the burner box 170. More specifically, the brackets 270, 275 can be L-shaped or Z-shaped flanges and support the burner body 230 in position within the rear section 175 of the burner box 170. Additionally, or alternatively, the burner 230 can be coupled to a sidewall of the burner box 170 or to the bottom panel 180. It is to be appreciated that the burner 230 could also be secured directly to a wall of the cooking cavity, to a bracket, or to any other component within the oven, so long as the burner 230 is positioned with its flame ports 280 below the rear opening 190 of the bottom panel 180 such that the flames or heat from the flames can extend or pass through the rear opening 190. The burner box 170 includes a plurality of flanges 320 extending outwardly from an upper edge of the sidewalls 172. Likewise, the bottom panel 180 includes a plurality of flanges 330 extending outwardly from a lower edge of corresponding sidewalls. The burner box flanges 320 can be mated with and secured to the bottom panel flanges 330. The heat duct 305 can be secured directly to an upper surface of the bottom panel 180 or fixed in place via brackets 340 and fasteners or the like. FIG. 4 illustrates the components of FIG. 3 in an assembled state.

Figure 5:
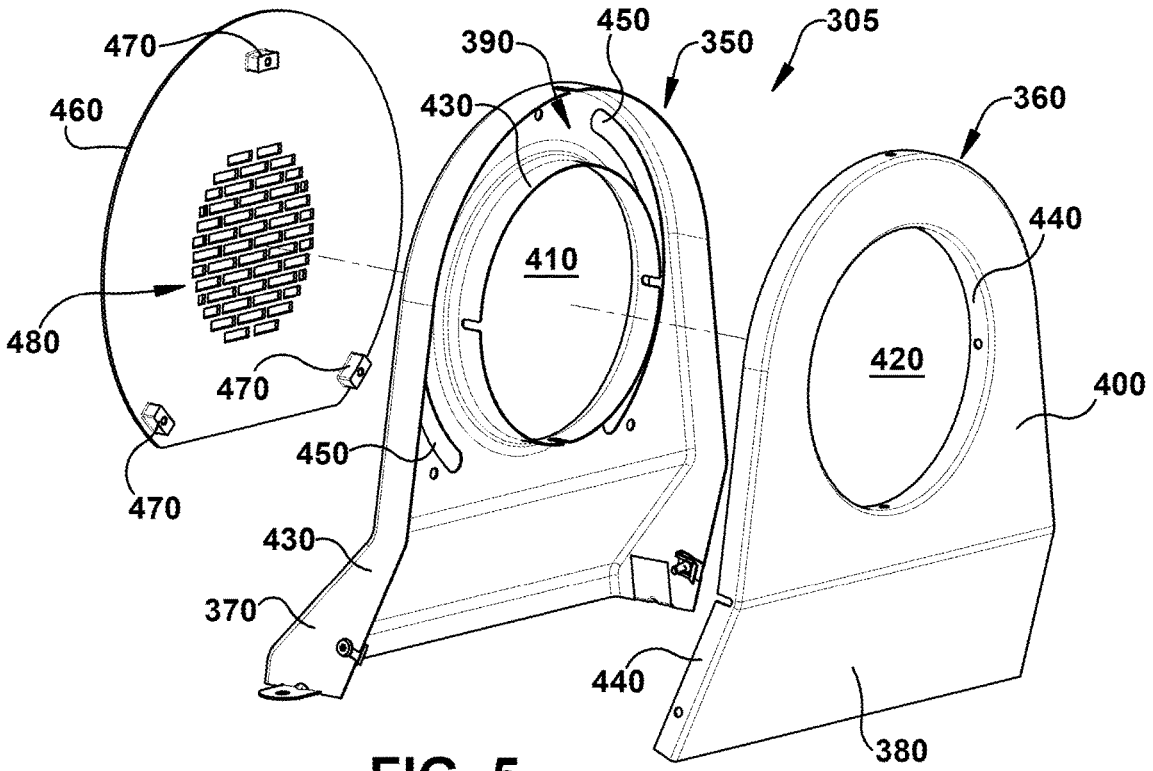
FIG. 5 illustrates an exploded rear perspective view of a heat duct and fan cover assembly in accordance with an embodiment.
Figure 6:
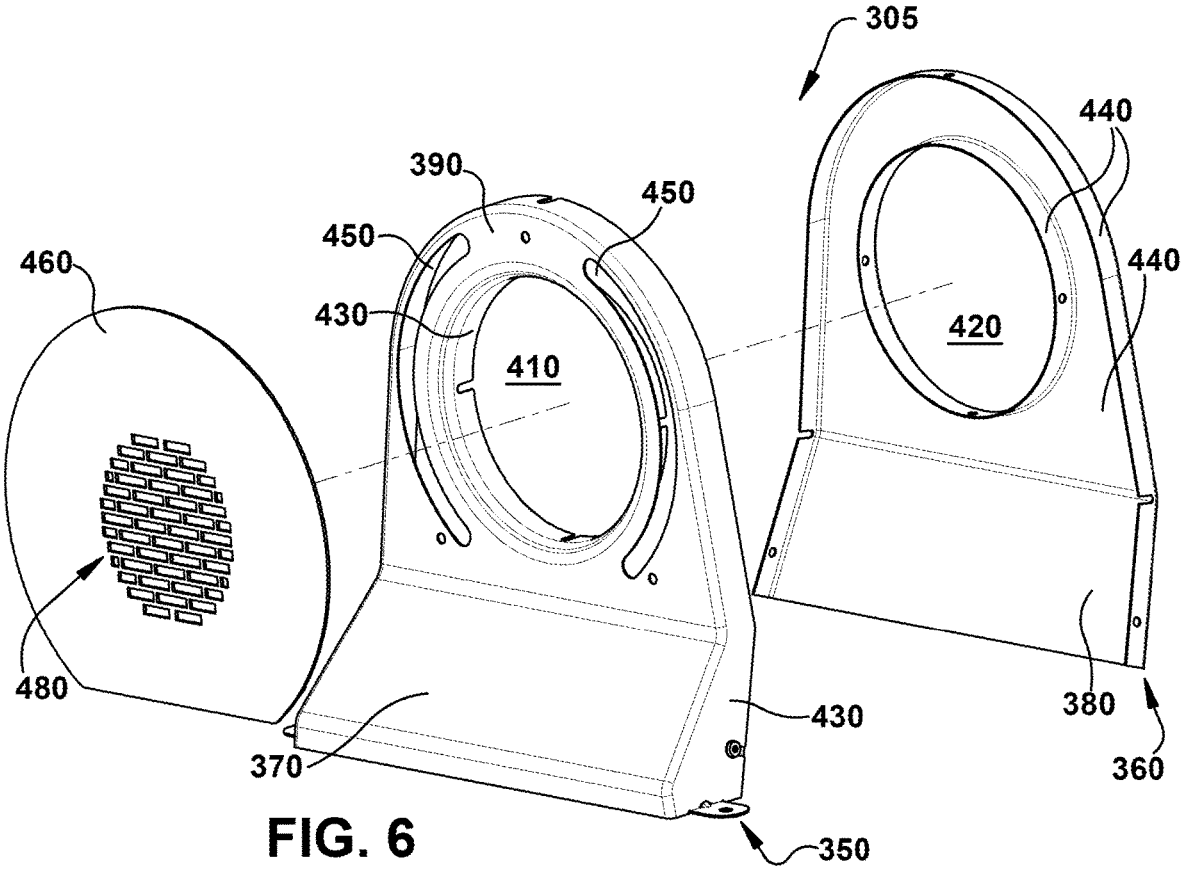
FIG. 6 illustrates an exploded front perspective view of a heat duct and fan cover assembly in accordance with an embodiment.
Figure 7:
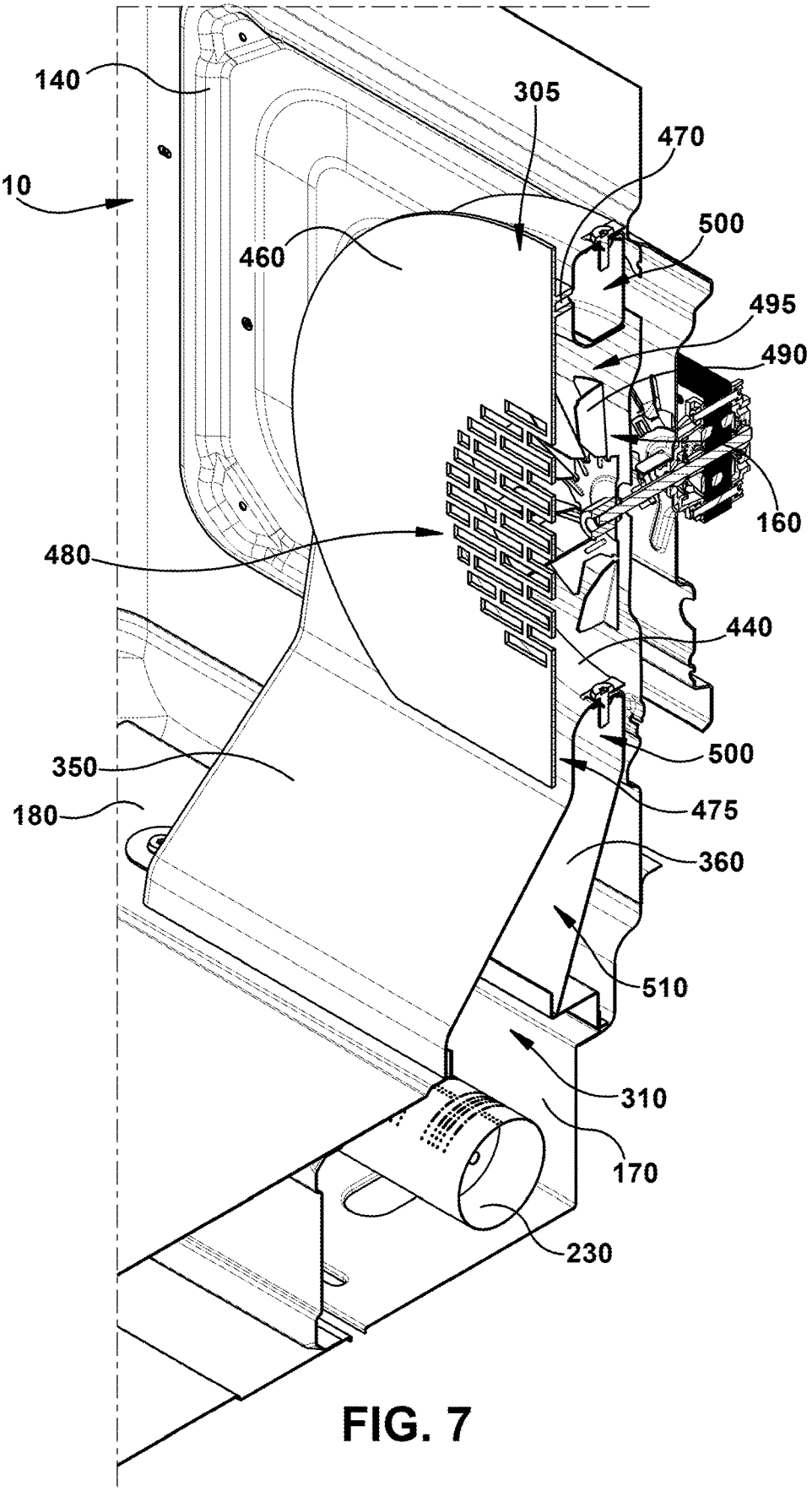
FIG. 7 illustrates a perspective section view of a heating channel exchange system within a cooking cavity in accordance with an embodiment.

FIGS. 5 and 6 illustrate an example heat duct 305 in more detail. The heat duct 305 includes a housing that can be made from an enameled metal material or the like. The housing includes an annular top portion and a rectangular-shaped bottom portion. The housing can comprise a first shell 350, forming a front half of the housing, and a second shell 360, forming a rear half of the housing. When coupled together, a continuous channel is defined between an inner face of the first shell 350 and an inner face of the second shell 360. The bottom portion 370 of the first shell 350 cooperates with a bottom portion 380 of the second shell 360 to define a wide, substantially planar channel 510 therebetween. As discussed above, a width of the substantially planar channel corresponds with a width of the rear opening 190 of the bottom panel 180. The first and second shells 350, 360 include substantially annular or ring-shaped top portions, 390, 400, each having a circular opening, or fan opening, 410, 420 through a center portion thereof. The fan openings 410, 420 are sized to correspond with a size of a convection fan 490 mounted to or at a rear of the cooking cavity 110. For example, the fan openings 410, 420 can be large enough such that the convection fan 490 can pass through the fan openings 410, 420. Thus, the fan openings 410, 420 define a pass-through opening 495 in the annular portion of the heat duct 305 when assembled (FIG. 7). Each of the first and second shells 350, 360 includes inwardly extending flanges 430, 440 around a circumference of the openings 410, 420 and around the sides and tops (i.e. the perimeter) of the first and second shells 350, 360, respectively. When assembled, an annular portion, or ring-shaped channel 500, is formed by the top portions 390, 400 of the first and second shells 350, 360. The ring-shaped channel 500 is open to the substantially planar channel 510 formed by the bottom portions 370, 380 of the first and second shells 350, 360. The channels 500, 510 formed within the housing are enclosed by the flanges 430, 400 and the inner faces of the first and second shells 350, 360.

One or more arcuate openings 450 are provided through the face of the first shell 350 and positioned around the fan opening 410 therein. The arcuate openings 450 are outlet ports or openings for the heat duct 305. More specifically, the arcuate openings 450 are provided through the ring-shaped channel 500. Thus, the heat duct 305 is substantially enclosed with an inlet port 310 through a bottom portion and one or more outlet ports provided through a front face of the housing. Secured to an outer face of the first shell 350 is a cover plate 460 which is spaced from the first shell 350 by a predetermined distance, as defined by one or more stand-offs 470. The cover plate 460 is sized to cover the pass-through opening 495 in the annular portion of the heat duct 305 and the outlets 450 provided through a front face of the housing. Because the cover plate 460 is spaced a distance from the front face of the housing, air flow is possible through a gap 475 formed between the front face of the housing and the cover plate 460. A plurality of openings 480 are provided through a central portion of the cover plate 460 and configured to allow airflow from the cooking cavity to be pulled into the convention fan 490.

Figure 8:
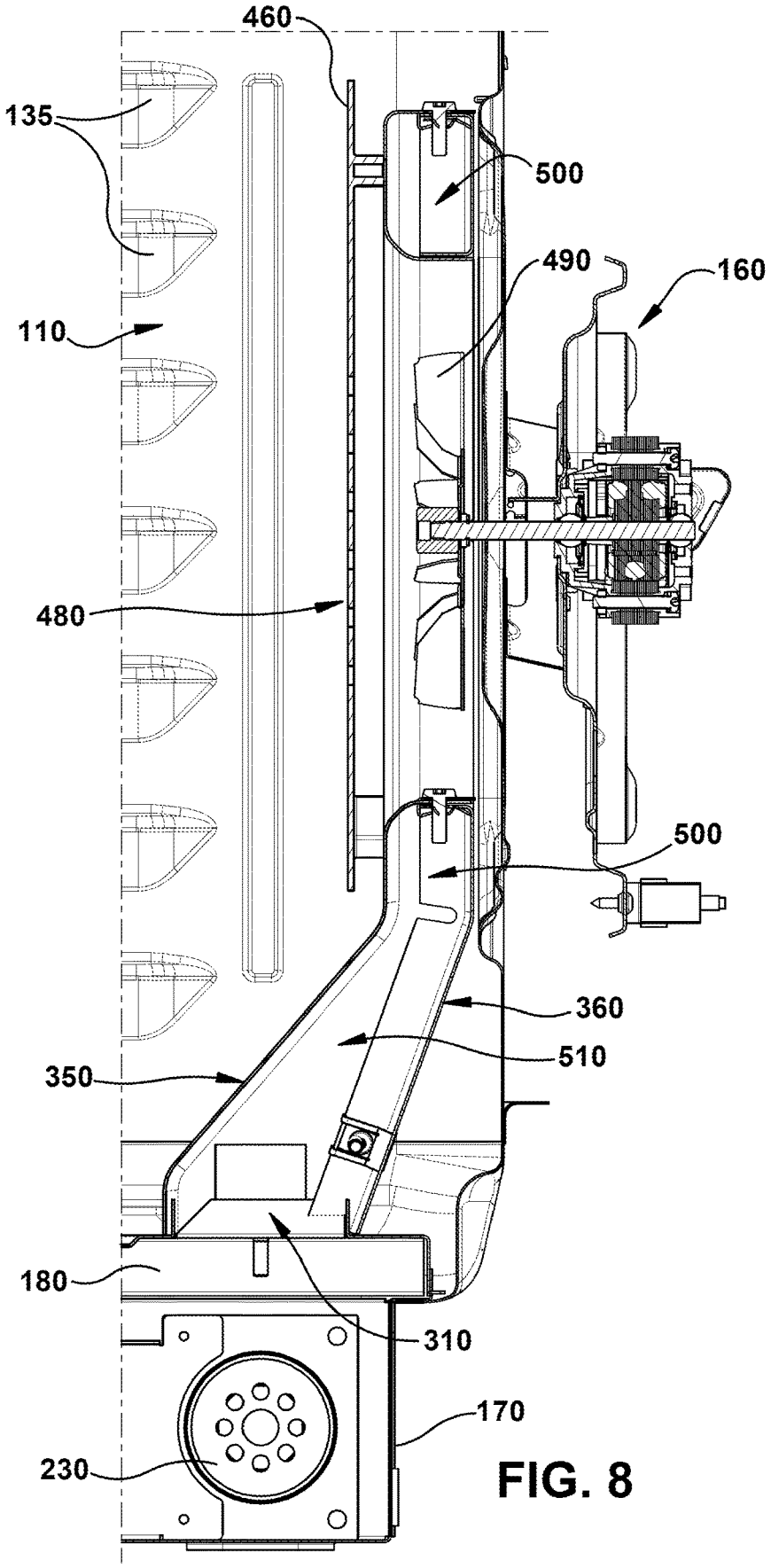
FIG. 8 illustrates a side sectional view of a heating channel exchange system within a cooking cavity in accordance with an embodiment.

FIGS. 7 and 8 illustrate cross sectional views of the heating channel exchange system positioned within a gas convection oven. The cooking cavity 110 is formed from a substantially box-like oven liner having an open front that is configured to be closed by an oven door, as known in the art. The cooking cavity 110 includes opposite first and second side walls 120, 130 that can be formed with or include a plurality of vertically spaced embossments or rack supports 135. A rear wall 140, a top wall and a bottom wall 150 are also provided. The top wall includes a standard oven exhaust vent for discharging the combustion-product gases outside of the oven, or to the external atmosphere. The heat duct 305 is positioned directly in front of and parallel to the rear wall 140 at a rear portion of the cooking cavity 110. The convection fan 490 is disposed adjacent to the rear wall 140 and extends through the pass-through opening 495 in the heat duct 305. In the present example, the pass-through opening 495 is formed by the openings 410, 420 in the first and second shells 350, 360. As shown, the heat duct 305 can be of a height that extends from the bottom panel 180 positioned at a bottom portion of the cooking cavity 110 to near the top wall. (See FIG. 9). A width of the heat duct 305 is greater than a width of the convection fan 490 and is preferably more than half a width of the cooking cavity 110, or in other words a distance between sidewalls 120, 130. Moreover, the width of the heat duct 305 can correspond to a length from a first flame port in the burner body 240 to a last flame port. Thus, each of the flame ports 280 can be positioned directly below the inlet port 310 of the heat duct 305. Accordingly, heated exhaust from the gas burner 230 flows vertically upwards into an interior volume of the heat duct 305.

As shown in FIG. 7, the convection fan 490 can extend through the pass-through opening 495 in the housing created by the fan openings 410, 420 in the first and second shells 350, 360. While only a single, centrally positioned convection fan is shown and described herein, any suitable number or configuration of fans can be employed. For instance, the oven can include two side-by-side fan assemblies attached to the rear wall. The convection fan 490 can be a multi-speed electric fan driven by a motor having a drive shaft with the fan 490 coupled to the drive shaft for rotation therewith. The fan 490 comprises a plurality of blades that can be curved or angled as desired. As shown, a continuous air flow channel is formed within the housing between inlet port 310 and outlet ports 450. The substantially ring-shaped channel 500 is formed around a periphery of the convection fan 490. The substantially planar channel 510 fluidly couples the ring-shaped channel 500 with the inlet port 310. Because the housing largely encloses the ring-shaped channel 500 and the planar channel 510, the subjacent space in which the gas burner 230 is positioned and thus, the flames from the gas burner 230, are substantially physically isolated from both the cooking cavity 110 and the convective air-flow path provided by the convection fan 490. There is substantially no path for combustion gases from the gas burner 230 to materially enter the cooking cavity 110 other than via the heat duct 305. Accordingly, there is little to no opportunity for the fan 490 to extinguish the gas flames from the burner 230. Accordingly, higher fan speeds are available as compared to conventional gas-convection systems where the convective air flow can pass directly over and disturb and/or extinguish flames exiting burner-flame ports.

The channels 500 and 510 are in fluid communication with the flame ports 280 of the gas burner 230. More specifically, each of the flame ports 280 provided through the top portion of the gas burner 230 is positioned under the rear opening 190 of the bottom panel 180. Thus, any flames exiting the ports 280 can extend from the gas burner 230 and through the rear opening 190. Thus, air flow through the heat duct 305 is heated directly by the burner 230, and preferably comprises the combustion products of the air/fuel mixture that is burned to generate flames on exiting the flame ports 280. This heated air (e.g. combustion-product mixture) flows vertically, upwardly, through the first, substantially planar channel 510 from the inlet port 310 and to the second, ring-shaped channel 500. From the ring-shaped channel 500, the heated air can exit via the arcuate openings 450 provided through the front face of the housing. Because the inlet port 310 of the housing surrounds the rear opening 190 in the bottom panel 180, the combustion products and associated heated air are contained within the housing until exiting through the one or more arcuate openings or outlet ports 450.

Figure 9:
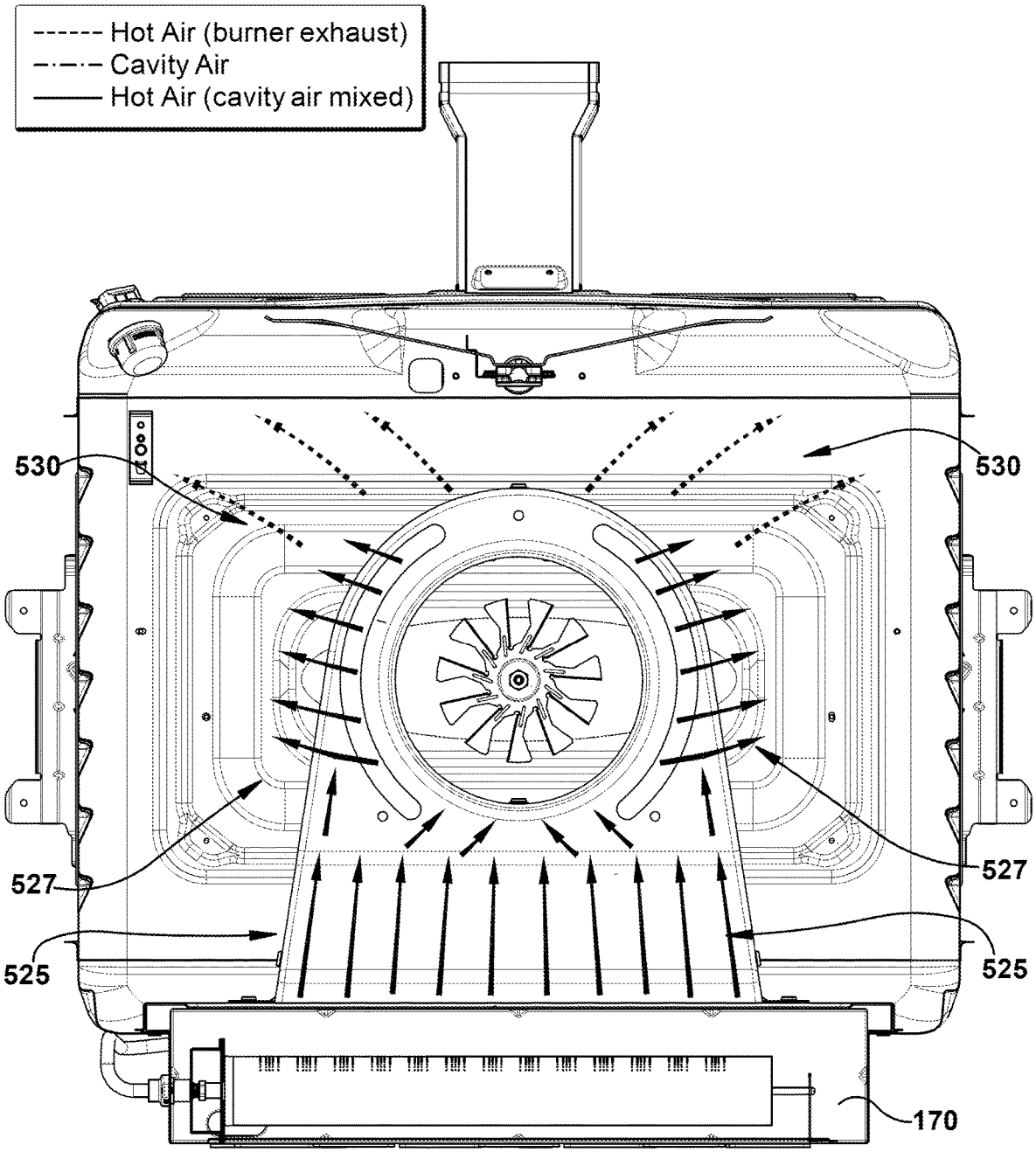
FIG. 9 illustrates an air flow diagram of an oven having a heating channel exchange system in accordance with an embodiment.
Figure 10:
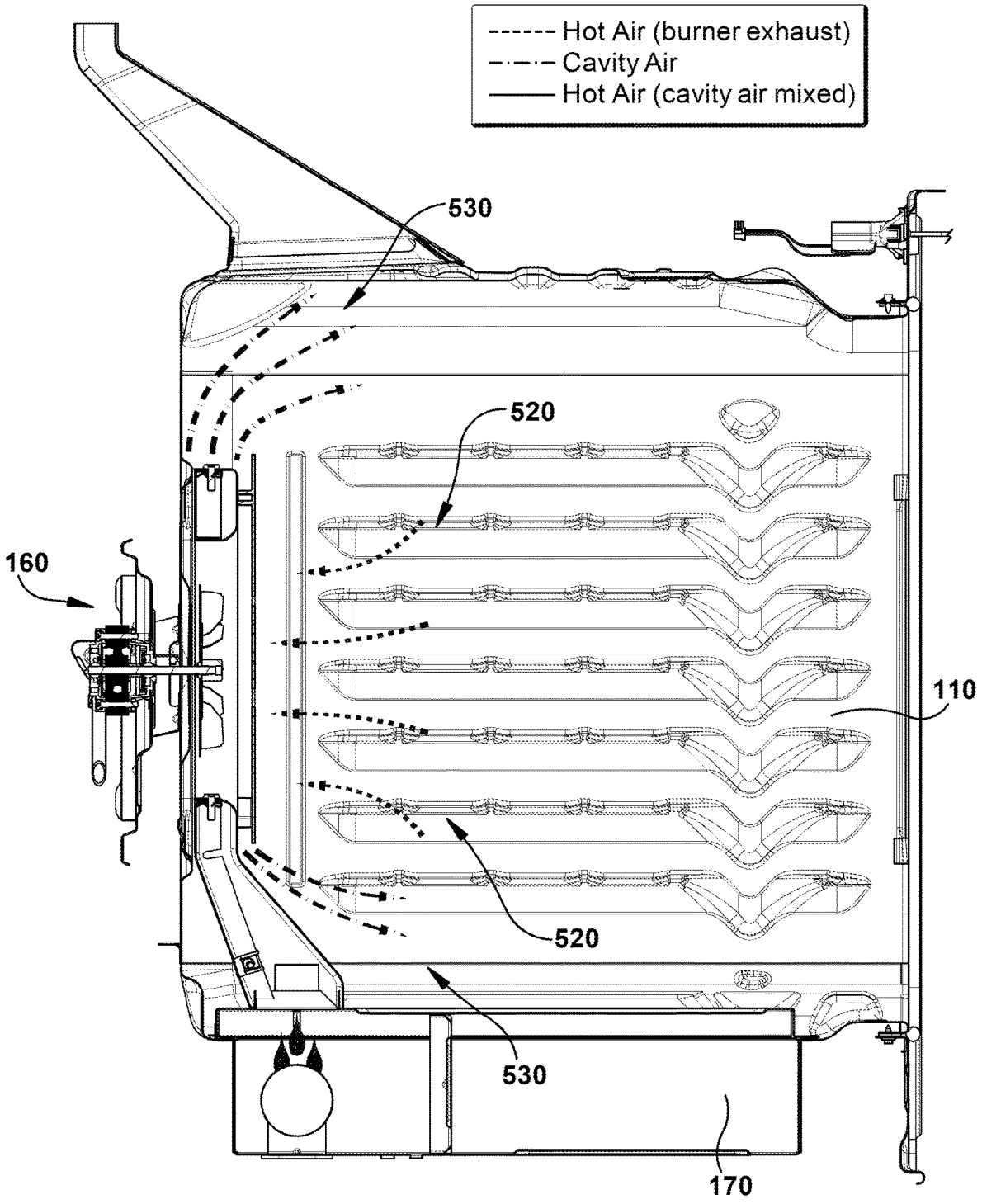
FIG. 10 illustrates an air flow diagram of an oven having a heating channel exchange system in accordance with an embodiment.

As illustrated by the airflow diagrams of FIGS. 9 and 10, the openings 480 in the cover plate 460 are aligned with the pass-through opening 495 of the heat duct 305. Accordingly, the convection fan 490 can draw in heated air from within the cooking cavity 110 through the openings 480 in the cover plate 460, as shown by arrows 520. More specifically, the convection fan 490 creates a negative pressure to draw the cooking cavity air through the openings 480 and thereafter the pass-through opening. The convection fan 490 then expels the air such that it is recirculated through the oven cavity such that the drawing of air induces a venturi flow and causes combustion gases to flow into the heat duct 305. The combustion gases from the gas burner 230 flow upwards into and through the inlet port 310 of the heat duct 305, as shown by arrows 525, and through the channels of the heat duct 305 until exiting via the one or more outlets 450 through the front face of the housing, as shown by arrows 527. In the gap 475 between the fan cover plate 460 and the front face of the housing, the heated burner exhaust can flow substantially radially outwards through the gap 475 between the fan cover plate 460 and the channel housing, around the cover plate 460, and into the cooking cavity 110, as shown by arrows 530, where it can mix with the cooking-cavity air. In addition, some portion of the heated burner exhaust exiting the heat duct 305 via outlet(s) 450 may be drawn radially inward, and than axially toward the fan together with cavity air being drawn axially through the pass-through opening 495. This portion of the heated burner exhaust mixes with the air drawn by the fan and is co-expelled radially therewith along arrows 527 to be circulated in the cooking cavity 110. This cavity-air/exhaust-gas mixture is thus circulated in the cooking cavity 110 where it is effective to cook present foodstuffs via convection. By drawing and circulating heated combustion air (exhaust) into the cooking cavity, more efficient operation can be obtained compared to heat-exchange systems where cavity air exchanges heat with the combustion gases across a barrier in a conventional heat exchanger, but without mixing the hot-side and cold-side fluid streams. This is because heat losses across the barrier between the two streams in the exchanger are avoided.

The instant system provides the dual benefits of isolating the gas burner from the convection system so that higher fan speeds can be used, and direct application of combustion gases as the convection-cooking medium, resulting in minimal thermal losses compared to heat-exchange.

Although embodiments described herein are made with reference to example embodiments, it should be appreciated by those skilled in the art that various modifications are well within the scope and spirit of this disclosure. Therefore, the scope of the example embodiments is not limited herein. The disclosure is intended to include all such modifications and alterations disclosed herein or ascertainable herefrom by persons of ordinary skill in the art without undue experimentation. It will be appreciated that the burner described herein can be used in convection ranges or ovens for residential and restaurant or other commercial or industrial applications.

What is claimed is:

1. A cooking appliance comprising:

a cooking cavity;

a convection fan disposed adjacent to a rear wall of the cooking cavity;

a gas burner located in a subjacent space beneath a bottom wall of the cooking cavity;

a heat duct having an inlet positioned directly above the gas burner through which combustion gases from the gas burner can enter the duct, and an annular portion defining a pass-through opening in which the convection fan is disposed, said annular portion having one or more outlets through which combustion gases can exit the heat duct; and a cover plate secured to a front face of the heat duct and spaced from the front face of the heat duct such that a gap is formed therebetween, wherein flames from the gas burner extend upwardly toward or through said inlet of said heat duct and are substantially isolated from turbulent air flow generated by the convection fan.

2. The cooking appliance of claim 1, the gas burner extending along a longitudinal axis thereof and having an array of flame ports distributed in its upper surface over its length, wherein a width of the inlet of the heat duct corresponds with a length of the array of flame ports.

3. The cooking appliance of claim 1, the subjacent space being isolated from the cooking cavity such that there is substantially no path for combustion gases from the gas burner to materially enter said cooking cavity other than via the heat duct.

4. The cooking appliance of claim 1, wherein the cover plate is positioned in front of the annular portion of the heat duct and spaced a distance therefrom.

5. The cooking appliance of claim 4, wherein the cover plate includes one or more openings aligned with the pass-through opening of the heat duct such that air can flow through the one or more cover plate openings to the convection fan.

6. The cooking appliance of claim 5, wherein operating the convection fan creates a negative pressure that draws air from the cooking cavity through the one or more openings in the cover plate and thereafter through the pass-through opening, and expels the air such that it is recirculated through the cooking cavity, wherein the drawing of air induces a venturi flow causing the combustion gases to flow into the heat duct through the inlet and out of the heat duct through the one or more outlets where the combustion gases mix with the air being drawn through the pass-through opening.

7. The cooking appliance of claim 4, said cover plate being spaced forward from the annular portion of the heat duct such that the gap is defined therebetween, wherein the one or more outlets of the heat duct are on a side of the annular portion thereof facing the cover plate adjacent the gap.

8. A cooking appliance comprising:

a cooking cavity having a convection fan disposed adjacent a rear wall of the cooking cavity;

a bottom panel positioned at a bottom portion of the cooking cavity;

a gas burner positioned directly below an opening in the bottom panel;

a heat duct having an inlet positioned directly above the opening in the bottom panel, an outlet positioned through a front face of the heat duct, and a channel extending between the inlet and the outlet; and a cover plate secured to a front face of the heat duct and spaced from the front face of the heat duct such that a gap is formed therebetween, wherein combustion gases from the gas burner travel through the heat duct channel and exit the heat duct via said outlet such that flames emanating from said gas burner are substantially isolated from turbulent air flow generated by the convection fan.

9. The cooking appliance of claim 8, wherein the heat duct includes an annular top portion having a pass-through opening through which the convection fan extends.

10. The cooking appliance of claim 9, wherein a ring-shaped channel extends through the annular top portion of the heat duct.

11. The cooking appliance of claim 8, further comprising a burner box positioned below the bottom panel, the gas burner positioned within a rear space of the burner box.

12. The cooking appliance of claim 8, wherein a width of the opening in the bottom panel is equal to or greater than a distance between a burner port closest to a first end of the gas burner and a burner port closest to a second end of the gas burner.

13. The cooking appliance of claim 12, wherein a width of the inlet of the heat duct is equal to or greater than the width of the opening in the bottom panel.

14. A cooking appliance comprising:

a cooking cavity having a rear wall and a bottom wall;

a gas burner positioned below the bottom wall;

a heat duct positioned at a rear portion of the cooking cavity, the heat duct having an inlet positioned directly above the gas burner, an outlet, a channel formed between the inlet and the outlet, and a pass-through opening;

a cover plate secured to a front face of the heat duct and spaced from the front face of the heat duct such that a gap is formed therebetween and a convection fan positioned adjacent the rear wall and extending into the pass-through opening of the heat duct.

15. The cooking appliance of claim 14, the heat duct comprising a first shell forming a front half of a housing of the heat duct and a second shell forming a rear half of the housing, wherein the inlet is formed at a bottom portion of the housing and the outlet is formed through a face of the first shell.

16. The cooking appliance of claim 14, wherein the outlet is an arcuate opening formed through a front face of the heat duct.

17. The cooking appliance of claim 14, wherein the channel comprises a first, substantially planar portion and a second, ring-shaped portion.

18. The cooking appliance of claim 17, wherein the outlet extends through the second, ring-shaped portion of the channel.

19. The cooking appliance of claim 17, the cover plate covering the pass-through opening and the outlet.

* * * * *